US007201826B2

(12) United States Patent
Klass et al.

(10) Patent No.: US 7,201,826 B2
(45) Date of Patent: Apr. 10, 2007

(54) HIGH PERFORMANCE NATURAL ZEOLITE MICROPARTICLE RETENTION AID FOR PAPERMAKING

(75) Inventors: Charles P. Klass, Randon, PA (US); Martin D. Sikora, Oxford, OH (US)

(73) Assignee: ZO Mineral Partners Ltd., San Antonio, TX (US)

( * ) Notice: Subject to any disclaimer, the term of this patent is extended or adjusted under 35 U.S.C. 154(b) by 436 days.

(21) Appl. No.: 10/847,066

(22) Filed: May 17, 2004

(65) Prior Publication Data

US 2005/0269050 A1 Dec. 8, 2005

(51) Int. Cl.

| | |
|---|---|
| ***D21H 21/10*** | (2006.01) |
| ***D21H 17/68*** | (2006.01) |
| ***C01B 33/20*** | (2006.01) |
| ***C01B 39/00*** | (2006.01) |

(52) U.S. Cl. ..... 162/181.6; 162/158; 423/327.1; 423/700; 424/684; 502/64

(58) Field of Classification Search ..... 162/164.2
See application file for complete search history.

(56) References Cited

U.S. PATENT DOCUMENTS

| | | | | |
|---|---|---|---|---|
| 4,388,150 | A | 6/1983 | Sunden et al. | |
| 4,752,341 | A | 6/1988 | Rock | |
| 4,756,801 | A | 7/1988 | Jokinen et al. | |
| 4,892,590 | A | 1/1990 | Gill et al. | |
| 5,071,512 | A | 12/1991 | Bixler et al. | |
| 5,900,116 | A * | 5/1999 | Nagan | 162/158 |
| 5,997,625 | A * | 12/1999 | Londo et al. | 106/486 |
| 6,193,844 | B1 * | 2/2001 | McLaughlin et al. | 162/181.6 |
| 2003/0019399 | A1 * | 1/2003 | Malla et al. | 106/416 |
| 2003/0051637 | A1 * | 3/2003 | Klass | 106/483 |
| 2003/0205346 | A1 * | 11/2003 | Klass et al. | 162/181.6 |

FOREIGN PATENT DOCUMENTS

| | | |
|---|---|---|
| JP | 45/41044 | 12/1970 |
| WO | WO 95/23021 | 8/1995 |

OTHER PUBLICATIONS

St. Cloud Natural Zeolite (Clinoptilolite), Product information sheet [online]. St. Cloud Mining Company, 2006 [retrieved on Jan. 4, 2007], Retrieved from the Internet: <URL: http://www.stcloudmining.com/PDF/stcloud/stcloud_zeolite-specifications.pdf>.*

Ford, Philip A., A New Multi Component Organic/Inorganic System, The Path Forward for Microparticle Technology, TAPPI Spring Technical Conference and Trade Fair, TAPPI Press, Atlanta, 2003.

Loranger, E and Chabot B, The Effect of Zeolite on Value—added paper Manufacturing, Pulp and Paper Canada, pp. 29-32, 105: 3(2004).

Moffett, Robert H, On Site Production of a Silica Based Microparticulate Retention and Drainage Aid, TAPPI Journal, vol. 77, No. 12, p. 133-138.

Knudson, M.I. , Bentonite in Paper: The Rest of the Story, 1993 Papermakers Conference pp. 141-151.

Li, HM and Scott W.E. The Use of Britt Jar Retention—RPM Curves & Microscopic Analysis to determine the Aggregation State of a Papermaking Funish.

Doiron, Benoit E. The Efficient Use of Retention Aid Systems in the Paper Industry—Current Trends 1994 Papermakers Conference p. 603-607.

Bernier, Jean-Francois and Begin, Bernard, Experience of a microparticle retention aid system, TAPPI Journal, vol. 77, No. 71.

Gess, Jerome M., A perspective on neutral/alkaline papermaking, TAPPI Journal Apr. 1992.

Retention of Fines and Fillers During Papermaking; TAPPI Press Book pp. 80-97.

Scott, William E., Principles of Wet Chemistry, TAPPI Press: Atlanta (1996) pp. 111-113.

Unbehend, John E, Mechanisms of "soft" and "hard" floc formation in dynamic retention measurement, TAPPI, vol. 59, No. 10 (1976).

Gil, R.I.S., Developments in Retention aid Technology, Paper Tech, vol. 32, No. 8 (1991).

* cited by examiner

*Primary Examiner*—Eric Hug
*Assistant Examiner*—Dennis Cordray
(74) *Attorney, Agent, or Firm*—Michelle Evans; Gunn & Lee, P.C.

(57) ABSTRACT

A microparticle retention aid for use in papermaking containing a high performance purified natural zeolite pigment is disclosed. Use of the pigment facilitates manufacture of papers with improved quality and economics. When used as filler, the novel zeolite pigment is readily retained and eliminates print-through in uncoated papers. The novel zeolite pigment is low in abrasion and provides improved coefficient of friction.

10 Claims, 3 Drawing Sheets

HIGH PERFORMANCE NATURAL ZEOLITE MICROPARTICLE RETENTION AID FOR PAPERMAKING

BACKGROUND OF THE INVENTION

1. Field of the Invention

Applicant's invention relates to a purified natural zeolite pigment that can be used as a microparticle retention aid that produces a paper that exhibits improved characteristics over existing papers made with other retention aids.

2. Background Information

Paper is a complex composite made up of a combination of biological, synthetic, and inorganic materials. The components include wood pulp or other fibers and fines (as well as other components of wood), inorganic (mineral) and organic fillers, natural and synthetic polymers (for sizing, retention and strength), and other additives to meet specific product or process requirements. Retention of the individual components in appropriate amounts is critical to the properties and quality of the paper sheet as well as minimizing pollution and cost.

Retention has been defined in the literature as the term used to describe the effectiveness of a given process to retain the components of the paper sheet or to describe the ability of a given material to be retained.[1] Retention describes the amount of a given material in the final product relative to the amount present at some earlier stage in the process.

1 Scott, W. E., *Principles of Wet End Chemistry* TAPPI Press: Atlanta (1996), p. 111.

In the past decade, retention has gained even more importance due to many changes in the paper industry. Paper machines have become bigger and run faster. Most fine paper mills have converted to alkaline papermaking conditions. This has permitted the use of new and less expensive filler systems, predominately calcium carbonate in some form (precipitated, ground, or chalk). In addition to a cost advantage, these fillers impart properties needed to meet more stringent product requirements. For example, very often the same sheet is expected to be suitable for both ink-jet printing and xerography. Generally the filler content of the sheet has increased and is likely to continue to increase. The switch to alkaline papermaking conditions has also resulted in a change in sizing chemistries. Synthetic sizes such as ASA (alkenyl succinic anhydride) and AKD (alkyl ketene dimer) are the predominant sizes used in alkaline papermaking.[2] How they interact with other components of the sheet and how and where they are retained is critical to the properties of the sheet. There are now trends toward neutral or alkaline conditions and increased filler usage in wood containing grades also. AS paper manufacturers recognize the costs of poor retention in terms of pollution abatement and product loss, they are striving to reduce or eliminate effluents from their mills. All these factors combine to make retention of papermaking materials one of the most important processes of the wet end operation.[3]

2 Gess, J. M., *Tappi Journal* 75 (4): 80 (1992).

3 Doiron, B. E., 1994 *TAPPI Papermakers Conference Proceedings*, TAPPI Press: Atlanta (1994), p. 603.

Retention of the various components of the stock in the final sheet is generally considered to be due to chemical, mechanical, or a combination of both mechanisms. While the dissolved materials are retained by adsorption or chemical bonding to the suspended solids, the suspended solids are retained by mechanical filtration or entrapment with the forming web of fiber, or preferably by physico-chemical attachment to the fibers, which are much larger, or to one another. This will occur to some degree regardless of attractive or repulsive forces between the particles. Because of their relatively small size, the particles which make up the fines fraction (inorganic fillers and cellulosic fines) are difficult to retain in the web, and much more of this material would pass through the wire and end up in the white water system if it were not for the addition of retention aids which enhance the colloidal retention of the fines fraction. Retention aids are water-soluble polyelectrolytes which cause the fines fraction to flocculate either with themselves or by adsorption onto the long fiber portion of the furnish, thus bringing about greater retention by both chemical and mechanical means.

Theory says there are two ways in which the fine particles in a papermaking web can be retained through physicochemical mechanisms:

1. By gathering the fine particles into a macroparticle.
2. By attaching the fine particles to the large fibers that are in turn retained at a 100% level.

As a rule, agglomeration, flocculation or coagulation is accomplished by changing the charge of one particle in relation to another. This is done by adding a high cationic charge density, low molecular weight polymer (in the case of an acid papermaking system) to a papermaking furnish. It is expected that the fiber fines and small filler particles, because of their higher surface area in comparison to fibers, interact preferentially with the polymers. The high charge density of these polymers will cause the formation of cationic spots on the filler particles and fiber fines. It then is hypothesized that the cationic centers on the filler particles and fiber fines will be attracted to the anionic centers on the fibers, and this will result in the retention of the fines and small filler particles with the fibers. Too high of a dose of agglomerant or coagulant will result in fiber-fiber repulsion and a loss in retention.

The terms agglomeration, flocculation and coagulation are often used interchangeably in papermaking. Agglomeration or flocculation was used by those working directly with paper machine personnel, while coagulation was used by those personnel working in water treatment. Agglomeration or flocculation is that interaction that occurs between oppositely charged materials. Coagulation, on a purely theoretical level, tends to be formation of macroparticles that occurs when the zeta potential of a system approaches zero and there is a maximum physicochemical interaction between the elements of the furnish.

Microparticle retention systems are considered to influence fine particle retention through a physicochemical mechanism of coagulation. Such a mechanism has long been thought to have the greatest impact on small particle retention.[4]

4 Unbehend, J. E, *Tappi* 59 (10): 74 (1976).

Modern microparticle systems include both soluble polyelectrolytes and a very small (5–10 nm) highly charged "microparticle" to destabilize a given colloidal particle suspension through a complex mechanism. Usually inorganic in nature, these particles typically possess a large anionic surface charge. Used in combination with soluble polyelectrolytes, such as cationic starch or polyacrylamides, wither cationic or anionic, microparticle retention systems provide a very powerful tool for optimizing retention.

Colloidal silica is the predominant microparticle used in papermaking retention systems today. The original colloidal silica micro particle introduced to the paper industry was a stable colloidal dispersion of spherical amorphous silica particles, about 5 nm in size.[5] A variety of particle sizes and three-dimensional silica sol structures have been presented in the last ten years.[6] Some of the three-dimensional silica aggregate structures have overall aggregate size small enough (20–50 nm) to maintain the colloidal dispersion properties of the individual silica particle. [5, 7]

5 Sunden, O., Batelson, P. G., Johansson, H. E., Larsson, H. M., and Svenging, P. J., U.S. Pat. No. 4,388,150 (Jun. 14, 1983).

6 Johansson, H., International Patent WO 95/23021 (Aug. 31, 1995).

7 Moffett, R. H., *Tappi Journal* 77 (12): 133 (1994).

One of the silica aggregates has been developed specifically to work with high-charged cationic polyacrylamide. This product is a highly branched, three-dimensional, silica aggregate with an overall particle size of approximately 50-nm.[7] Moffett reported that the highly structured, larger sized silica aggregates appear to be the most efficient silica particles used in conjunction with a wide range of cationic polyacrylamides.[7]

7 Moffett, R. H., *Tappi Journal* 77 (12): 133 (1994).

It can be seen that one of the shortcomings of silica microparticle systems is the need to use different physical structures for the various papermaking applications. Another limitation on the use of silica microparticle retention aids is their very high cost.

Colloidal bentonite clay with a high smectite component, specifically montmorillonite, is another mineral commonly used in microparticle retention systems. The attribute similar to the silica microparticles is the high surface area and high charge on the particle, which, in combination, promotes the coagulation mechanism of retention of small fillers and fines. Colloidal bentonites that are effective in microparticle systems are three-dimensional particles that are up to 300 nm long and have a very thin, uniform thickness of less than 1 nm.[8] High purity montmorillonite is critical for using colloidal bentonites as a microparticle in retention systems.[8]

8 Kundson, M. I., 1993 *TAPPI Papermakers Conference Proceedings*, TAPPI Press: Atlanta, 1993, p. 141.

Other types of inorganic microparticle retention systems have been presented in the literature.[9,10,11] The filler retention performance of the system based on aluminum hydroxide in-situ in conjunction with cationic starch is close to that of silica and bentonite-based microparticle systems. From an economic standpoint, the level of cationic starch needed results in an expensive system and can result in paper quality problems, such as poor sheet formation. Additionally, because of the unique pH-dependent distribution of alumina species, fines retention is very dependent upon pH. While good retention performance can be obtained in a pH range from 7.8–8.6, a pH drop to only 7.5 can result in a 25% reduction in fines retention.[12]

9 Bixler, H. J. and Peats, S., U.S. Pat. No. 5,071,512 (Dec. 10, 1990)

10 Jokinen, O. J. Petander, L. and Virta, P. J., U.S. Pat. No. 4,756,801 (Jul. 12, 1988).

11 Gill, R. A. and Sanders, U.S. Pat. No. 4,892,590 (Jan. 9, 1990).

12 Gill, R. I. S., *Paper Tech.,* 32(8): 34 (1991).

Existing microparticulate retention aids, namely silica and bentonite, have many disadvantages, so a goal of the present invention was to develop a microparticle retention system that incorporates a zeolite pigment with at least the same or superior qualities to those of the existing microparticles.

A zeolite pigment that possesses the desirable combination of brightness, color, particle size distribution, surface area, internal void volume, rheology and hardness could also be useful in overcoming the limitations of conventional and other specialty pigments in various papermaking and paper coating applications including but not limited to: (1) more economical microparticle retention system chemistry; (2) toner bond improvement in laser and other dry toner imaged digital papers; (3) elimination of smudging and improvement of print quality in direct print flexography on coated linerboard used in corrugated containers; (4) elimination of print through on newsprint and ultra light weight coated papers; (5) improvement of dot fidelity and print quality on coated rotogravure printing papers; (6) low abrasion extender for titanium dioxide pigments; (7) improvement of coefficient of friction of paper and paperboard; (8) production of technical specialty papers such as anti-tarnish, gas filtration, and absorbent papers with improved properties and lower cost of manufacture; (9) additive to improve the efficiency of deinking systems; (10) additive to reduce problems with pitch, stickies and/or other organic deposits in pulping and papermaking systems.

Zeolites are crystalline, hydrated aluminosilicates of the alkali and alkaline earth metals. More particularly, zeolites are framework silicates consisting of interlocking tetrahedrons of $SiO_4$ and $AlO_4$. In order to constitute a zeolite, the ratio of silicon and aluminum to oxygen must be 2. The aluminosilicates structure is negatively charged and attracts the positive cations that reside within. When exposed to higher charged ions of a new element, zeolites will exchange the lower charged element contained within the zeolite for a higher charged element. Unlike most other tectosilicates, zeolites have large vacant spaces or cages in their structures that allow space for large cations such as sodium, potassium, barium, and calcium and relatively large molecules and cationic molecules, such as water, ammonia, carbonate ions, and nitrate ions. In most useful zeolites, the spaces are interconnected and form long wide channels of varying sizes depending on the mineral. These channels allow ease of movement of the resident ions and molecules into and out of the structure.

Zeolites are characterized by 1) a high degree of hydration, 2) low density and large void volume when dehydrated, 3) stability of the crystal structure of many zeolites when dehydrated, 4) uniform molecular sized channels in the dehydrated crystals, 5) ability to absorb gases and vapors, 6) catalytic properties, and 7) cation exchange properties.

There are several mentions of the use of synthetic zeolites as a wet end additive in papermaking. In U.S. Pat. No. 4,752,314 Rock teaches the use of a combination of titanium dioxide and synthetic Zeolite A wherein the sodium has been at least partially replaced with calcium and/or hydronium ion to improve the optical properties of paper. Rock teaches that the Zeolite A must have a composition: Zeolite (Ca-.sub.x Na.sub.y)A zH.sub.2 O where x is in the range of 0.3 to 3.6, y is in the range of 9.6 to 11.85 and z is in the range of 20 to 27 or Zeolite (Ca.sub.x Na.sub.y Hy) zH.sub.2 O where x is in the range of 0 to 4.8, y is in the range of 0.6 and z is in the range of 20 to 27.

In U.S. Pat. No. 5,900,116 Nagan teaches the use of a synthetic zeolite crystalloid coagulant with particle size 4 to 10 nm in combination with cationic acrylamide polymer as a papermaking retention aid.

The use of natural zeolites in paper making has a long history, but has been almost unique to Japan where zeolite has been used as filler to improve bulkiness and printability.[13] Natural zeolites have also been used as fillers for paper in Hungary. These natural zeolites however are a low brightness material and this renders it unsatisfactory for application in the United States on uncoated office paper and on coated ink jet paper where high brightness is expected.

13 Japanese patent application No. 45-41044 with disclosure date Dec. 23, 1970.

Numerous families of natural zeolites exist and each has varying characteristics. Unfortunately, natural zeolites exhibit nonuniform properties that make them difficult to work with in many applications because ores from one location can vary with any other. It is however possible to manufacture zeolites with uniform properties. The preferred zeolite for use in the present invention is a processed form of the natural mineral clinoptilolite which is a hydrated sodium potassium calcium aluminum silicate having the formula $(Na, K, Ca)_{2-3}\ Al_3\ (Al,Si)_2\ Si_{13})_{36}\text{-}12H_2O$. This zeolite is within the family Heulandite that also includes the mineral heulandite, which is a hydrated sodium calcium aluminum silicate. The physical characteristics of raw clinoptilolite are listed in Table 1.

TABLE 1

| PHYSICAL CHARACTERISTICS OF CLINOPTILOLITE |
|---|
| Color is colorless, white, pink, yellow, reddish and pale brown. |
| Luster is vitreous to pearly on the most prominent pinacoid face and on cleavage surfaces. |
| Transparency: Crystals are transparent to translucent. |
| Crystal System is monoclinic; 2/m. |
| Crystal Habits include blocky or tabular crystals with good monoclinic crystal form. More tabular and proportioned than heulandite. |
| Also commonly found in acicular (needle thin) crystal sprays. |
| Cleavage is perfect in one direction parallel to the prominent pinacoid face. |
| Fracture is uneven. |
| Hardness is 3.5 B 4, maybe softer on cleavage surfaces. |
| Specific Gravity is approximately 2.2 |
| Streak is white. |

Clinoptilolite's structure is sheet like with a tectosilicate structure where every oxygen is connected to either a silicon or an aluminum ion (at a ratio of [Al+Si]/0=2). The sheets are connected to each other by a few bonds that are relatively widely separated from each other. The sheets contain open rings of alternating eight and ten sides. These rings stack together from sheet to sheet to form channels throughout the crystal structure. The size of these channels controls the size of the molecules or ions that can pass through them. Clinoptilolite is well suited for various applications, such as in paper coating compositions, because it exhibits large pore space, high resistance to extreme temperatures, and has a chemically neutral structure.

The zeolite of the present invention is not anticipated by either Rock in U.S. Pat. No. 4,752,341 or Nagan in U.S. Pat. No. 5,900,116. The structure of the natural zeolite of the present invention falls outside of the range of structures specified by Rock in U.S. Pat. No. 4,752,341. The particle sizes of the natural zeolite of the present invention are 2 to 3 orders of magnitude greater than the 4 to 10 nm specified by Nagan in U.S. Pat. No. 5,900,116.

SUMMARY OF THE INVENTION

An object of the present invention is to provide a novel purified natural zeolite pigment that can be used as a microparticle in a retention aid system.

Another object of the present invention is to provide a novel purified natural zeolite that can be used as a catalyst in chemical processes.

In satisfaction of these and related objectives, Applicant's present invention provides a purified natural zeolite pigment that can be used as a microparticle for a retention aid system. Applicant's invention permits its practitioner to manufacture paper that exhibits improved characteristics over existing papers such as high print quality images and reduced cost. It also permits the practitioner to make other specialty and technical papers that exhibit quality and economic advantages over papers made with existing technology and commercially available materials.

DETAILED DESCRIPTION OF THE PREFERRED EMBODIMENT

Figure 1:
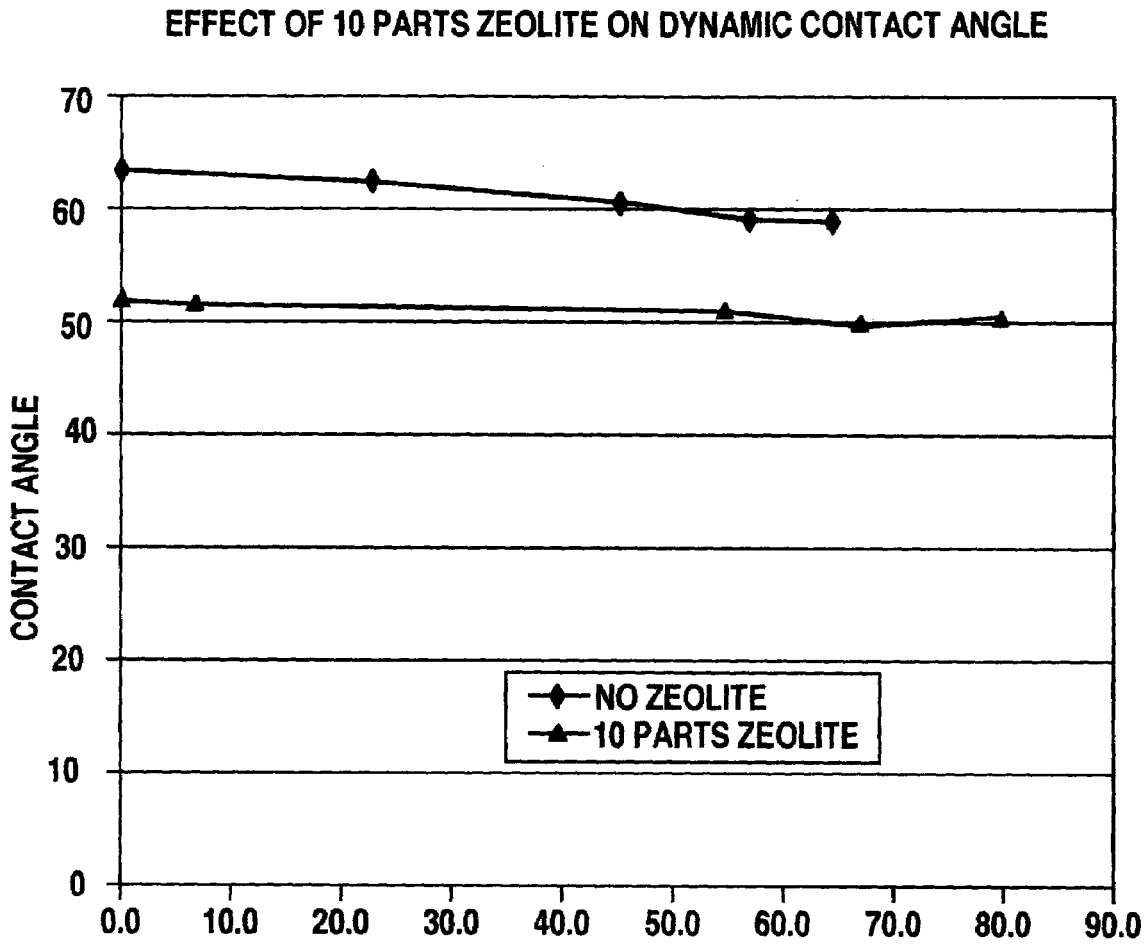
FIG. 1 is a graph of the dynamic contact angle versus time for compositions both with and without zeolite pigment.

The processed zeolite used in the present invention has several specific characteristics as indicated in Table 2.

TABLE 2

Characteristics of Zeolite Pigment Samples

| Specification | Zeolite Pigment Sample 1 | Zeolite Pigment Sample 2 |
|---|---|---|
| GE Brightness[14] % | 94+ | 90+ |
| L[15] | 98.46 | 98.00 |
| a | 0.43 | 0.44 |
| b | 1.25 | 1.72 |
| Yellowness Index | 2.48 | 2.05 |
| Particle Size μ, <D90 | 2.0 | 2.0 |
| Einlehner Abrasion, mg loss | 12 | 18 |
| Loose Density, lbs./cu.ft. | 8 | 8 |
| Packed Density, lbs./cu.ft. | 12 | 12 |
| Refractive Index | 1.48 | 1.48 |
| Surface Area, sq.m./g. | 40–50 | 40–50 |
| Oil Absorption, lbs./100 lbs. | 70–80 | 70–80 |
| Density, g/cc | 2.2 | 2.2 |
| pH in Water | 5.0 | 8.5 |
| Cation Exchange Capacity | 1.6–1.8 | 1.8–2.0 |
| Brookfield Viscosity, 20 rpm @ 40% solids* | 1000 cPs | 1000 cPs |
| Hercules Viscosity @ 1100 rpm* | 1 dyne | 1 dyne |

*Nonoptimized dispersion in water

[14]GE Brightness is a directional brightness measurement utilizing essentially parallel beams of light with a wavelength of 457 nm to illuminate the paper surface at an angle of 45°. It is also referred to as TAPPI Brightness. GE or TAPPI Brightness is the value obtained by TAPPI Test method T646 om-94 "Brightness of Clay and Other Mineral Pigments" (45 degrees/0 degrees).

[15]L, a, b values are the chromacity coordinates or color values of paper or paperboard measures with tristimulus filter colorimeters or spectrophotometers incorporating direction (45°/0°) geometry and CIE (International Commission on Illumination) illuminant C. "L" represents lightness, increasing from zero for black to 100 for white; "a" represents redness when plus, greenness when minus and zero for gray; "b" represents yellowness when plus, blueness when minus, and zero for gray. This is referred to as TAPPI Test Method T 524 om-94 "Color of Paper and Paperboard (45°/0° Geometry)."

Pilot paper machine trials were run comparing the use of the zeolite of the present invention to precipitated calcium carbonate (PCC) as filler. The trials showed significant advantages of the present zeolite pigment as filler. These pilot machine filler trials were run without use of retention aid polymers. It was found that the filler retention for the present zeolite was 2.5 to 4 times as high as PCC, which facilitates running a cleaner wet end with improved sheet formation and uniform optical properties. The significantly higher retention achieved with the zeolite of the present invention is an indication that it can perform well as a substitute for silica or bentonite in microparticulate retention systems. Silicas currently used in this application are not cost effective. The improved retention of the zeolite pigment is an indication that it would be useful as an alternative to costly silica as a deinking aid.

In addition, porosity tests showed that the present zeolite produced a more open sheet, which would facilitate the use of this pigment in specialty gas filtration papers and anti-tarnish papers. It was also found that the zeolite pigment of the present invention produced papers that had higher tensile strength and tensile energy absorption or stretch. Papers filled with the present zeolite also had a higher coefficient of friction, which decreases the likelihood of misfeed and jams in copiers and also improves performance in converting equipment and print shops. The zeolite of the present invention can also be useful as a frictionizer for coefficient of friction control in recycled linerboard.

The capability of the zeolite pigment to reduce print-through was evaluated by printing samples from the pilot paper machine trials on a proof press and visually inspecting them for evidence of print show-through. The control sample with no filler showed severe print-through. The sample filled with 100 pounds of zeolite pigment (4.59% measured ash content) showed no evidence of print-through. Samples filled with PCC at levels up to 250 pounds per ton showed little improvement over the unfilled control with regard to print-through. The superior performance of the zeolite pigment in minimizing print-through is an indication that it would be useful in production of ultra lightweight-coated publication papers.

Microparticle Retention Systems

EKA's Compozil™ system using colloidal silica has become a standard against which other microparticulate retention systems are measured for highly-filled papermaking systems. Another very popular microparticle system in use is Ciba's Hydrocol™ system utilizing bentonite as the mineral microparticle. While there are other (colloidal polymer) microparticle systems in use, silica and bentonite dominate the mineral pigment sector of these systems.

Many laboratory devices and test methods have been developed in order to enable the investigator to evaluate pulps, retention aids, fillers, and other additives without resorting to a trial on a full-size paper machine. These include modifications of devices used to measure freeness and handsheet making equipment as well as devices designed specifically to measure retention.

Standard handsheet making equipment such as a British hand sheet mold equipped with a means of re-circulating white water can prove useful in laboratory studies. The advantage, in addition to being fast and simple, is that the resulting handsheets can also be tested. However, these are static methods and do not simulate the turbulence and shear forces that the furnish would be subjected to on a paper machine.

The Dynamic Drainage Jar developed by Britt and Unbehend attempts to simulate conditions encountered on a paper machine.[16] The device determines the relative tendency of the fines fraction to pass through the screen with the fluid phase or to remain adsorbed as a part of the solid phase. The result is expressed as retention of the fines fraction under selected and controlled turbulence conditions.

16 Li, H. M., and Scott, W. E, 2000 *TAPPI Papermakers Conference Proceedings*, TAPPI Press: Atlanta (2000), p. 1.

Because it is not possible to duplicate the performance of a paper machine in an experimental device without in effect building an experimental paper machine with all the complexity of a real paper machine, Britt and Unbehend argue that a laboratory device which measures the relative tendency of the fines fraction to be retained or to follow the water over a range of turbulence would be useful in evaluating retention for a wide range of machines. This is what the Dynamic Drainage Jar was designed to do, and it has been accepted as the industry standard throughout the world.

Because of the wide range of papermaking furnish combinations in commercial practice, our focus in this study was to identify a model system that would generate the most useful information for the intended initial screening. Value-adding pigments are most often found to be used in significant quantities in bleached free sheet furnishes, rather than in wood-containing (newsprint or magazine) or unbleached chemical (corrugated container) pulp systems. To that end, a general furnish of bleached northern kraft pulp was chosen, with a 60% hardwood (HW), 40% softwood (SW) blend refined to a Canadian Standard Freeness[17] of approximately 420 ml.

17 Canadian Standard Freeness is a measure of how much water a given papermaking pulp suspension will 'hold' under simple gravity. It is designed to give a measure of how easily a dilute suspension of pulp (3 grams in 1 Liter of water) may be drained. This is important in the papermaking process because it influences the amount of power needed to run the machine and ultimately the speed at which the machine may operate.

There are several important paper properties that are developed or enhanced by the addition of pigments (fillers), but the first challenge of papermaking is to keep the added pigments in the sheet during web formation and consolidation[18] from a suspension that is more than 99% water. This challenge is most often called "filler retention." The classical method for evaluating filler retention potential is by the use of a dynamic drainage device, typically called a Britt Jar™. This screening evaluation was conducted using a Britt Jar™ at several internal propeller speeds to simulate paper machines running over a wide range of line speeds.

18 Web formation is defined as creating a loosely combined sheet structure, typically with fibers or filaments, which are consolidated (bonded) through any number of web methods. Web formation processes include spun bonded and spun melt composites, melt blown, carded, wet laid, air laid and porous film. Web consolidation processes include thermal bonded, resin or chemical product, spunlaced or hydroentangled, thru-air bonded, needle punched, and stitchbonded.

Pigments involved in this study were scalenohedral[19] precipitated calcium carbonate (PCC), the zeolite of the present invention, bentonite, and colloidal silica. The overall purpose of this study was to evaluate the zeolite of the present invention as a potential filler to a papermaking furnish and to evaluate the zeolite of the present invention as a potential contributor to a microparticle retention system in a rather highly-filled papermaking furnish. Specifically concerning the microparticulate retention system, the present inventors wanted to determine (1) if the zeolite of the present invention had the potential to replace colloidal silica or bentonite and (2) if so, is there any significant difference in performance among the different grades of zeolite of the present invention when used to replace the colloidal silica and bentonite. In order to determine the potential of the zeolite pigment of the present invention as a filler and in a microparticulate retention system, several zeolite pigment samples were used. The samples were designated as ZO Brite-1, ZO Brite-1 new, ZO Brite-select and ZO Brite-3 and their characteristics are listed in Table 3.

19 A scalenohedron is a six-sided polyhedron, similar to a bipyramidal hexagon, but the adjoining area at the center is diagonal between every side as opposed to being level. Other modifications might also be present.

TABLE 3

Specifications for ZO Brite-1, ZO Brite-1 new, ZO Brite-3, and ZO Brite-select samples

| Specifications | ZO Brite-1 | ZO Brite-1 new | ZO Brite-3 | ZO Brite-select |
|---|---|---|---|---|
| GE Brightness | 92+ | 94+ | 90+ | 90+ |
| L | 97 | 98 | 96 | 96 |
| a | −0.1 | −0.3 | 0.44 | 0.33 |
| b | 1.45 | 1 | 1.72 | 1.72 |
| YI Yellowness Index | 2.25 | 2 | 2.5 | 2.5 |
| Particle Size u < D90 | 2 | 2 | 2 | 0.5 |
| Einlehner Abrasion | 12 | 12 | 18 | 18 |
| Loose Density (lbs/cu.ft) | 4 to 8 | 4 to 8 | 4 to 8 | 0.1–0.2 |
| Packed Density (lbs/cu.ft) | 12 to 16 | 12 to 16 | 12 to 16 | 2–4 |
| Refractive Index | 1.48 | 1.48 | 1.48 | 1.48 |
| Surface Area (sq.m./g) | 40 to 50 | 40 to 50 | 40 to 50 | 2400–3200 |
| Oil Absorption (lbs/100 lbs) | 70 to 80 | 70 to 80 | 70 to 80 | NA |
| Density (g/cc) | 2.2 | 2.2 | 2.2 | 2.2 |
| pH in water | 5 | 5 | 8.5 | 8.5 |
| Cation Exchange Capacity | 1.0–2.0 meq/g | 1.0–2.0 meq/g | 1.0–2.0 meq/g | 1.0–2.0 meq/g |
| Brookfield Viscosity (cP @ 20 rpm) | 820 | 820 | 27.5 | NA |
| Hercules Viscosity (kilodyne-cm @ 1100 rpm | 138 | 138 | 1 | NA |

As mentioned earlier in the specification, the present zeolite showed promise as filler in a papermaking furnish. That work was conducted at relatively low paper machine speed, about 200 fpm. These results were confirmed with the Britt Jar™ run at 500 rpm. Total solids retention with PCC was about 85% and with the present zeolite it was about 98%. Total solids retention remained very high with the present zeolite when used as the filler, even as Britt Jar™ speed was increased to 1500 rpm, as shown in Table 4. This was entirely unexpected.

TABLE 4

Total solids retention with varying Britt Jar ™ speeds

| Pigment | 500 rpm | 1000 rpm | 1500 rpm |
|---|---|---|---|
| 20% PCC | 85% | 78% | 78% |
| 20% ZOBrite-1 | 98% | 98% | 98% |

These experiments were run with no retention aid added to the furnish and adjusted to pH 8. Even though these data represent total solids retention rather than retention of filler alone, they suggest that even under relatively high-shear conditions found on fast paper machines, the present zeolite may have a natural tendency to be retained in the sheet. The possibility exists that addition of the present zeolite as papermaking filler could reduce the need for expensive retention aids.

A series of Britt Jar™ runs were performed using a filler loading of 20% PCC. A suitable base retention aid system for this model furnish was determined to be 2 lb/ton cationic retention aid and 5 lb/ton cationic starch.

The summary data are presented below in Tables 5a–5c based on varying Britt Jar™ speeds.

TABLE 5a

Britt Jar ™ results @ 1500 rpm

| Microparticle | % filler retention (avg.) | Std. deviation |
|---|---|---|
| None | 15.9 | 5.23 |
| 1 lb/ton silica | 48.7 | 1.37 |
| 1 lb/ton ZO Brite-1 | 47.0 | 0.14 |
| 1 lb/ton ZO Brite-select | 51.4 | 0.97 |
| 1 lb/ton ZO Brite-1 new | 45.3 | 3.46 |
| 1 lb/ton ZO Brite-3 | 49.0 | 1.22 |
| 2 lb/ton bentonite | 47.7 | 1.52 |
| 4 lb/ton bentonite | 54.8 | 1.01 |

TABLE 5b

Britt Jar ™ results @ 1000 rpm

| Microparticle | % filler retention (avg.) | Std. deviation |
|---|---|---|
| None | 50.7 | 3.52 |
| 1 lb/ton silica | 63.6 | 0.64 |
| 1 lb/ton ZO Brite-1 | 63.6 | 0.35 |
| 1 lb/ton ZO Brite-select | 64.6 | 1.07 |
| 1 lb/ton ZO Brite-1 new | 60.9 | 3.98 |
| 1 lb/ton ZO Brite-3 | 68.7 | 0.53 |
| 2 lb/ton bentonite | 68.9 | 2.7 |
| 4 lb/ton bentonite | 71.8 | 0.8 |

TABLE 5c

Britt Jar ™ results @ 500 rpm

| Microparticle | % filler retention (avg.) | Std. deviation |
|---|---|---|
| None | 97.8 | 0.98 |
| 1 lb/ton silica | 85 | 2.23 |
| 1 lb/ton ZO Brite-1 | 89.8 | 1.46 |
| 1 lb/ton ZO Brite-select | 85.6 | 1.38 |
| 1 lb/ton ZO Brite-1 new | 84.1 | 1.8 |
| 1 lb/ton ZO Brite-3 | 96.9 | 1.26 |
| 2 lb/ton bentonite | 94.8 | 2.01 |
| 4 lb/ton bentonite | 93.4 | 2.68 |

The data in Table 5a represent the results one might expect on a relatively fast paper machine. Based on these runs, it was determined that adding a silica microparticle to the base retention aid system significantly improves filler retention, there is no statistical difference in performance between the silica used and ZO Brite-1 as a microparticle for filler retention, and there is no statistical difference in performance between ZO Brite-1 and ZO Brite-1 new as a microparticle for filler retention. However, it may be noteworthy that there is a large difference in the variation of performance of ZO Brite-1 new, compared to that of ZO Brite-1, as evidenced by the difference in standard deviations within each run. There is no statistically significant difference in performance between 2 lb/ton bentonite and 1 lb/ton ZO Brite-1 as a microparticle for filler retention. There is no statistically significant difference in performance between 2 lb/ton bentonite and 1 b/ton ZO Brite-3 as a microparticle for filler retention. But there is a statistically significant improvement in filler retention when using 4 lb/ton bentonite compared to using 2 lb/ton bentonite. This difference also exists when comparing 4 lb/ton bentonite to 1 b/ton ZO Brite-1 or 1 lb/ton ZO Brite-3. There is a statistically significant improvement in filler retention when using 1 lb/ton ZO Brite-select compared to using silica or ZO Brite-1. There is a statistically significant improvement in filler retention when using 1 lb/ton ZO Brite-select compared to using 2 lb/ton bentonite. 4 lb/ton bentonite generated better filler retention than 1 lb/ton ZO Brite-select when used as a microparticle for filler retention. Similar data were generated at Britt Jar™ speeds of 1000 rpm and 500 rpm. These are presented in Tables 5b and 5c.

The figures in the present application help illustrate the differences in performance that may exist between microparticles in this retention system under different paper machine operating speeds. This illustrates why retention aid systems need to be specifically tailored for a particular paper machine and grade of paper. The most significant conclusion from studying each of the following figures is that the present zeolite shows substantial promise as a microparticle for retention aid systems.

Figure 2:
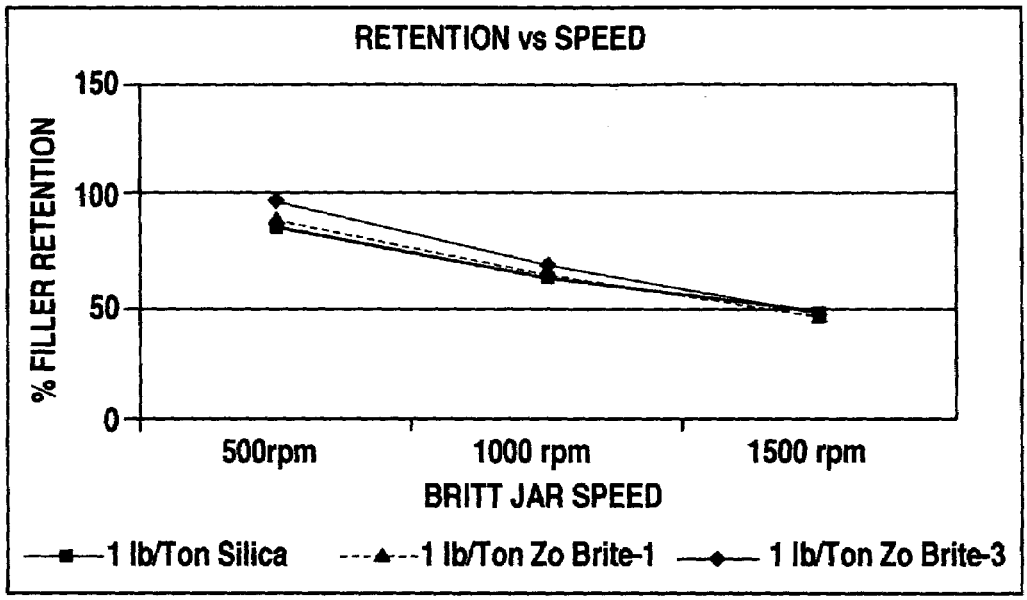
FIG. 2 is a graph of Britt Jar™ speed versus % filler retention for ZO Brite-1, ZO Brite-3 and silica.
Figure 3:
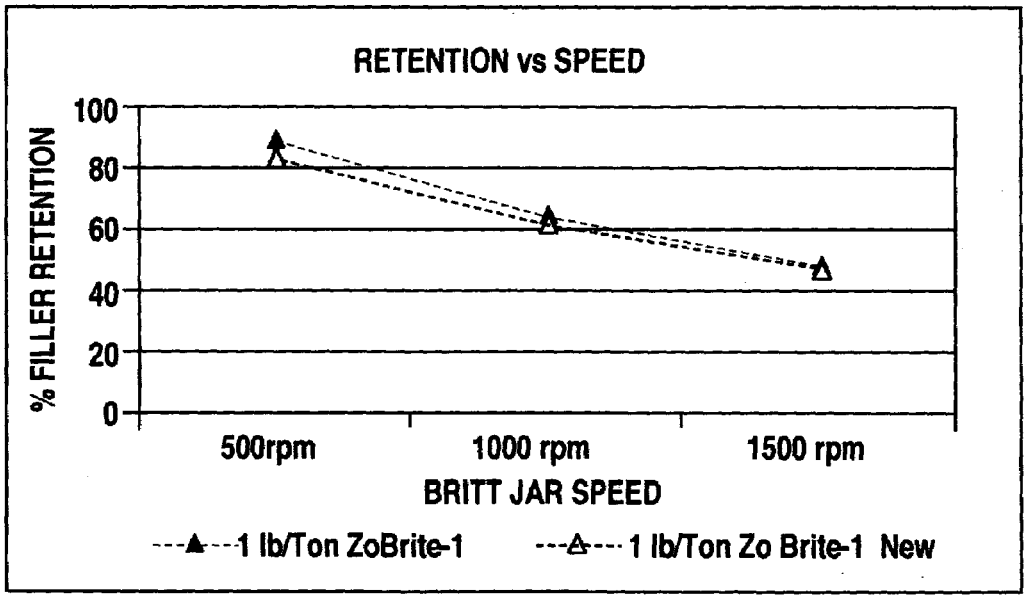
FIG. 3 is a graph of Britt Jar™ speed versus % filler retention for ZO Brite-1 and ZO Brite-1 new.

FIG. 2 illustrates the relative performance of the present zeolite, specifically ZO Brite-1 and ZO Brite-3, with silica over a range of Britt Jar™ speeds. The x-axis shows the range of Brift Jar™ speeds, 500 rpm, 1000 rpm and 1500 rpm, while the y-axis represents the % filler retention. At 500 rpm ZO Brite-1 and ZO Brite-3 have only slightly higher % filler retention than silica. Although visually encouraging, there is no statistical difference in performance between silica and ZO Brite-1 or ZO Brite-3 as a microparticle for filler retention at 500 rpm. When the speed is increased to 1000 rpm, the % filler retention for ZO Brite-1 and silica are the same with only ZO Brite-3 having a slightly higher % filler retention. At 1500 rpm, ZO Brite-1, ZO Brite-3 and silica show no significant difference in % filler retention. The present zeolites perform at least as well as silica over the entire range of Brift Jar™ speeds FIG. 3 illustrates the relative performance of two zeolites of the present invention, namely ZO Brite-1 and ZO Brite-1 new. The x-axis shows the range of Britt Jar™ speeds, 500 rpm, 1000 rpm and 1500 rpm, while the y-axis represents the % filler retention. At 500 rpm, ZO Brite-1 had a higher % filler retention than ZO Brite-1 new. When the speed was increased to 1000 rpm, ZO Brite-1 had only a slightly higher % filler retention than ZO Brite-1 new. At 1500 rpm, the % filler retention for ZO Brite-1 and ZO Brite-1 new showed no significant differences.

While these two pigments appear to perform comparably, there is a statistically significant decrease in performance of ZO Brite-1 new at low speed (500 rpm). While the difference at 1500 rpm is not statistically significant, it's most likely due to the variability of performance of the ZO Brite-1 new.

Figure 4:
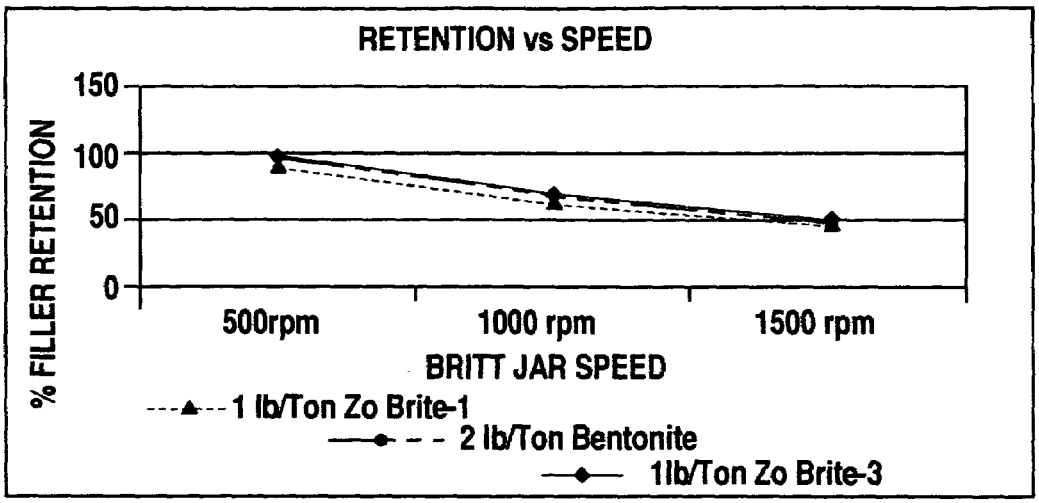
FIG. 4 is a graph of Britt Jar™ speed versus % filler retention for bentonite, ZO Brite-1 and ZO-Brite-3.

FIG. 4 illustrates the performance comparison between bentonite (2 lb/ton) and ZO Brite-1 and ZO Brite-3 (1 lb/ton). The x-axis shows the range of Britt Jar™ speeds, 500 rpm, 1000 rpm, and 1500 rpm, while the y-axis represents the % filler retention. There is no statistical difference between the bentonite performance (2 lb/ton) and that of the ZO Brite-1 or ZO Brite-3 (1 lb/ton) as the microparticle for filler retention, even at low speeds.

Figure 5:
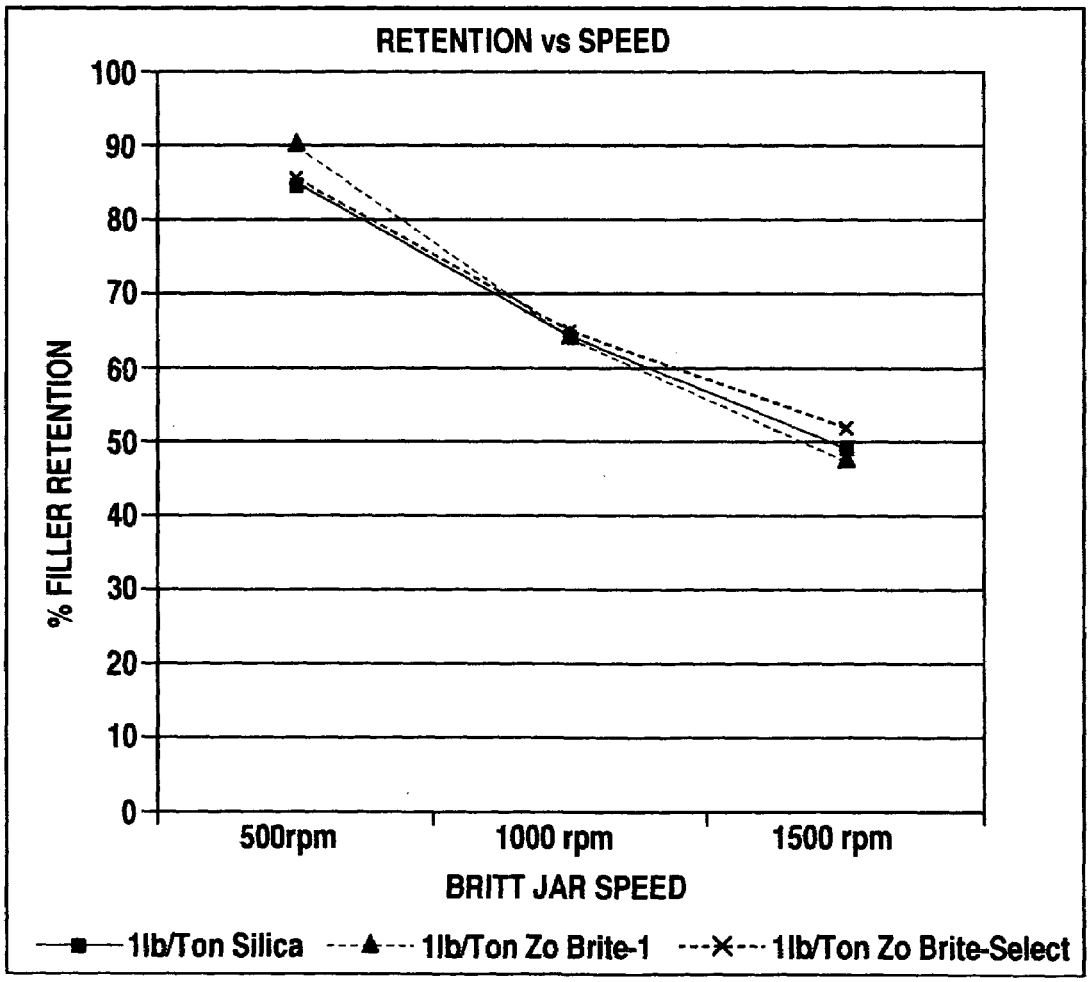
FIG. 5 is a graph of Britt Jar™ speed versus % filler retention for ZO Brite-1, ZO Brite-Select and silica.

FIG. 5 illustrates the relative performance of silica, ZO Brite-1 and ZO Brite-select. The x-axis shows the range of Britt Jar™ speeds, 500 rpm, 1000 rpm and 1500 rpm, while the y-axis represents the % filler retention. At 500 rpm, ZO Brite-1 has a higher % filler retention than silica or ZO Brite-select. At 1000 rpm, each pigment shows approximately the same % filler retention. And at 1500 rpm, ZO Brite-select has a higher % filler retention than the other two pigments. As illustrated, there is a statistically significant improvement in filler retention at high Britt Jar™ speeds when using 1 lb/ton ZO Brite-select compared to using either silica or ZO Brite-1 as the microparticle in a retention aid system. It is evident from the data that the zeolite of the present invention can be used as a pigment filler for wet end addition, with a natural tendency to be retained at relatively high speeds, potentially reducing the need for retention aids.

The zeolite of the present invention can also be used in a microparticle retention aid system. ZO Brite-1 performed well against colloidal silica at comparable levels of addition. ZO Brite-1 also performed well at an addition level of 1 lb/ton against bentonite added at 2 lb/ton.

ZO-Brite-select, the smallest particle size tested for the zeolite of the present invention performed better at 1 lb/ton than either silica or ZO Brite-1 at comparable addition levels, and better than bentonite at 2 lb/ton.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

What is claimed is:

1. A microparticle retention aid comprising the zeolite pigment clinoptilolite, wherein said zeolite pigment has a BET surface area in the range of 2400 to 3200 $m^2/g$.

2. The microparticle retention aid of claim 1 wherein said zeolite pigment has a particle size in the range of about 0.5–2.0 microns.

3. The microparticle retention aid of claim 1 wherein said zeolite pigment has a refractive index of about 1.48.

4. The microparticle retention aid of claim 1 wherein said zeolite pigment has a cation exchange capacity in the range of about 1.0–2.0 meq/g.

5. The microparticle retention aid of claim 1 wherein said zeolite pigment has a density of about 2.2 g/cc.

6. Paper comprising a microparticle retention aid having the zeolite pigment clinoptilolite, wherein said zeolite pigment has a BET surface area in the range of 2400 to 3200 $m^2/g$.

7. The paper of claim 6 wherein said zeolite pigment has a particle size in the range of about 0.5–2.0 microns.

8. The paper of claim 6 wherein said zeolite pigment has a refractive index of about 1.48.

9. The paper of claim 6 wherein said zeolite pigment has a cation exchange capacity in the range of about 1.0–2.0 meq/g.

10. The paper of claim 6 wherein said zeolite pigment has a density of about 2.2 g/cc.

* * * * *